United States Patent [19]

Fredd

[11] 4,216,830

[45] Aug. 12, 1980

Best Available Copy

[54] FLAPPER VALVE

[75] Inventor: John V. Fredd, Dallas, Tex.

[73] Assignee: Otis Engineering Corporation, Dallas, Tex.

[21] Appl. No.: 957,153

[22] Filed: Nov. 2, 1978

[51] Int. Cl.[2] ..... E21B 43/12; F16K 17/00

[52] U.S. Cl. ..... 166/319; 137/504; 251/298

[58] Field of Search ..... 166/323, 319, 322; 137/504; 251/79, 58, 298, 337

[56] References Cited

U.S. PATENT DOCUMENTS

| | | | |
|---|---|---|---|
| 2,780,290 | 2/1957 | Natho | 166/319 |
| 2,921,601 | 1/1960 | Fisher, Jr. | 137/504 |
| 3,072,141 | 1/1963 | Wheeler, Jr. | 137/512.1 |
| 3,872,884 | 3/1975 | Busdiecker et al. | 137/504 |
| 3,980,135 | 9/1976 | Garrett | 166/322 |
| 3,981,358 | 9/1976 | Watkins | 251/79 |

*Primary Examiner*—James A. Leppink
*Attorney, Agent, or Firm*—Vinson & Elkins

[57] ABSTRACT

A subsurface valve for use in a well having a hinged flapper closure element and a moveable fluid pressure actuated operator element and a resilient member connecting the operator element to the closure element.

16 Claims, 13 Drawing Figures

Fig. 11
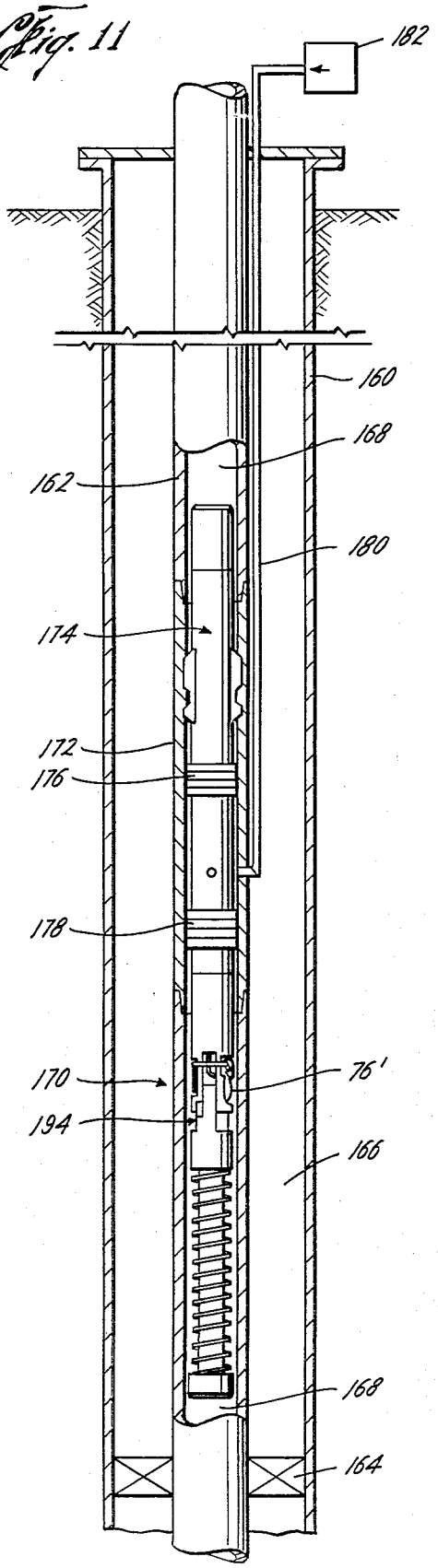
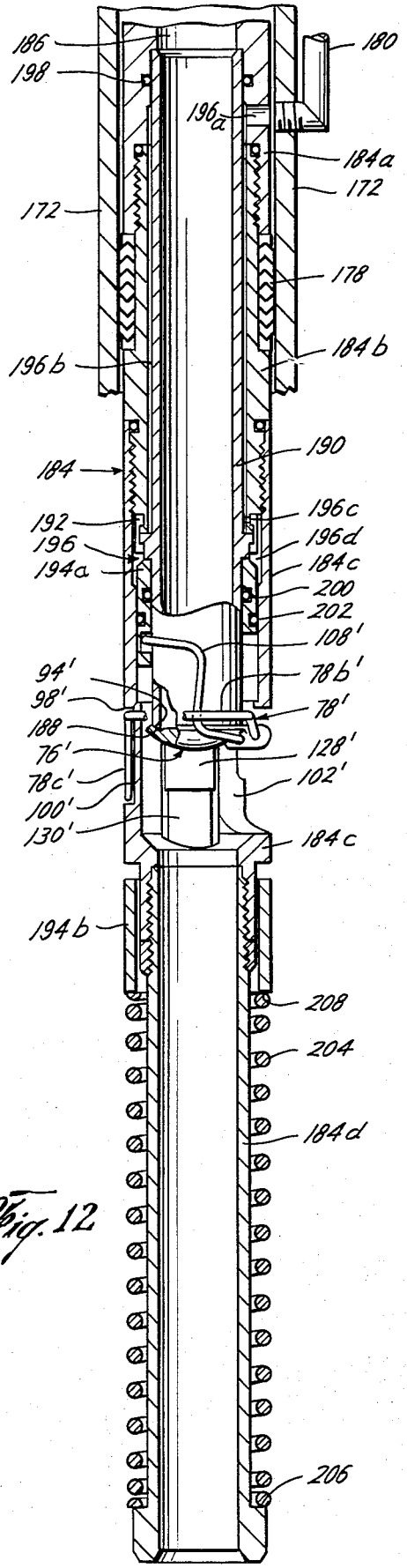
Fig. 12

FLAPPER VALVE

BACKGROUND OF THE INVENTION

1. Field of the Invention

This invention relates to a subsurface valve for controlling flow in a well and having a flapper closure element. One form of the valve is surface controlled while other forms open and close depending upon flow and/or pressure conditions at the valve.

2. The Prior Art

Subsurface valves having a flapper valve member are illustrated in the "COMPOSITE CATALOG OF OIL-FIELD EQUIPMENT AND SERVICES", on pages 479, 1175, 4573, 4574 and 4575 of the 1976–77 edition and pages 4000, 4003, 4008, and 4009 of the 1974–75 edition. The subsurface valves therein disclosed have a common limitation. They all have a rigid, stationary hinge for the flapper closure element. During operation of the respective valves, the hinge of each is subjected to destructive forces. Therefore, upon repeated openings and closings, the rigid, stationary hinge either breaks or is stressed beyond its elastic limit and takes a plastic set. The subsurface valve is thereby rendered inoperative.

Forces which are destructive to the flapper hinge are presently generated during closure for all types of subsurface valves having a flapper closure element and may be generated during the opening of a surface controlled subsurface safety valve having a flapper closure element. Presently, subsurface valves having a flapper closure element also have a control tube. When the valve is open, the control tube extends across the flapper closure element and maintains the closure element out of the flow path. The control tube has to be moved to an out-of-the-way position during valve closure. While the control tube is moving to its out-of-the-way position, the flapper closure element is pivoting towards its on-seat position. During its pivotal movement, the flapper closure element will enter the subsurface flow path. Thereafter, flowing well fluids will impinge upon the flapper closure element and increase the speed at which it is pivoted towards its on-seat position. The control tube cannot move to its out-of-the-way position as rapidly as the flapper closure element is pivoted towards its seat. Therefore, the flapper closure element strikes the control tube violently. When the flapper closure element strikes the control tube, an impactive potentially destructive force is imparted to the flapper hinge. During the opening of a surface controlled subsurface safety valve having a flapper closure, the lower end of the control tube strikes the flapper closure element while the closure element is in its on-seat position. If high shut-in formation pressures exist, the flapper closure element is subjected to large opposing forces. A force generated by the shut-in formation fluids tends to maintain the flapper closure element in its on-seat position. A force applied by the control tube tends to pivot the flapper closure element off of its on-seat position. When the control tube does pivot the flapper closure element off of the seat, the combination of the high opposing forces acting upon the flapper closure element and fluids flowing past the flapper closure element may adversely affect the flapper hinge.

Heretofore, pressure differential operated subsurface valves having a flapper closure element have not been able to quickly close the subsurface flow path. Additionally, such valves have tended to create a motor effect during closure. The inability to quickly close the flow path is due to the use of a control tube. The control tube has to be moved through a relatively long stroke to permit the flapper closure element to move to its on-seat position. Movement of the control tube takes time. Movement of the flapper closure element to its on-seat position is therefore delayed until the control tube has moved to its out-of-the-way position. A motor effect during closure results due to the interaction between the resilient urging opening force and the pressure differential closing force. For a normally opened, pressure differential operated, subsurface valve having a flapper closure element, an inherently resilient means urges the flapper closure element towards its open position. A high rate of fluid flow through the valve creates a differential pressure force which force tends to urge the flapper closure element towards its on-seat position. When the differential pressure force becomes greater than the resilient urging force, valve closure is initiated. However, when the flapper closure element enters the flow path, the flow rate is decreased. In fact, occasionally the fluid flow actually ceases and the fluid "bounces". When that occurs, the shut-in pressure of well fluids below the valve reduces. The resilient urging force tending to open the valve becomes greater than the differential pressure force tending to close the valve. The flapper closure element is moved towards its pivoted open position. The sequence is repeated rapidly causing the flapper closure element to motor.

U.S. Pat. No. 3,072,141 to Wheeler, Jr., discloses a valve having a floating pivotal mounting for the flapper closure element. The hinge of the flapper closure element receives a relatively rigid hinge pin. The patent discloses that either the journals for the hinge pin or the hinge holes may be elongated to provide the floating pivotal mounting.

U.S. Pat. No. 3,981,358 to Watkins et al discloses a valve having a flapper closure element and a rigid flapper hinge. The control tube for moving the flapper closure element comprises at least two telescopable members. The members are designed to telescope to a collapsed position before excessive forces are applied to the control tube or the flapper closure element. Therefore, if such a valve was surface controlled, it could not open if a substantial pressure differential existed across the flapper closure element. Additionally, such a valve would continue to have the deficiencies noted for other valves during closure.

OBJECTS OF THE INVENTION

An object of this invention is to improve the pivotal mounting for a flapper closure element of a subsurface valve.

Another object of this invention is to decrease the time required for a flapper closure element of a subsurface valve to move from its pivoted open position to its on-seat position.

Another object of this invention is to reduce the tendency of a subsurface valve having a flapper closure element to motor during valve closure.

Another object of this invention is to dissipate the energy imparted to a flapper closure element of a subsurface valve during valve closure in a nondestructive manner so that the flapper closure element and flapper pivot are not adversely affected.

Another object of this invention is to provide a subsurface valve having a flapper closure element which closure element can be lifted off of its seat prior to being pivoted towards its full open position.

These and other objects, and features of advantage, of this invention will be apparent from the drawings, detailed description, and the appended claims.

BRIEF DESCRIPTION OF THE DRAWINGS

In the drawings, wherein like numerals indicate like parts, and wherein illustrative embodiments of this invention are shown:

FIG. 11 is a schematic illustration of a well installation incorporating a surface controlled subsurface safety valve in accordance with this invention and having a flapper closure element;

FIG. 12 is a view, partly in section and partly in elevation, of the safety valve of FIG. 11 with the flapper closure element in the closed position.

DETAILED DESCRIPTION OF THE PREFERRED EMBODIMENTS

Figure 1:
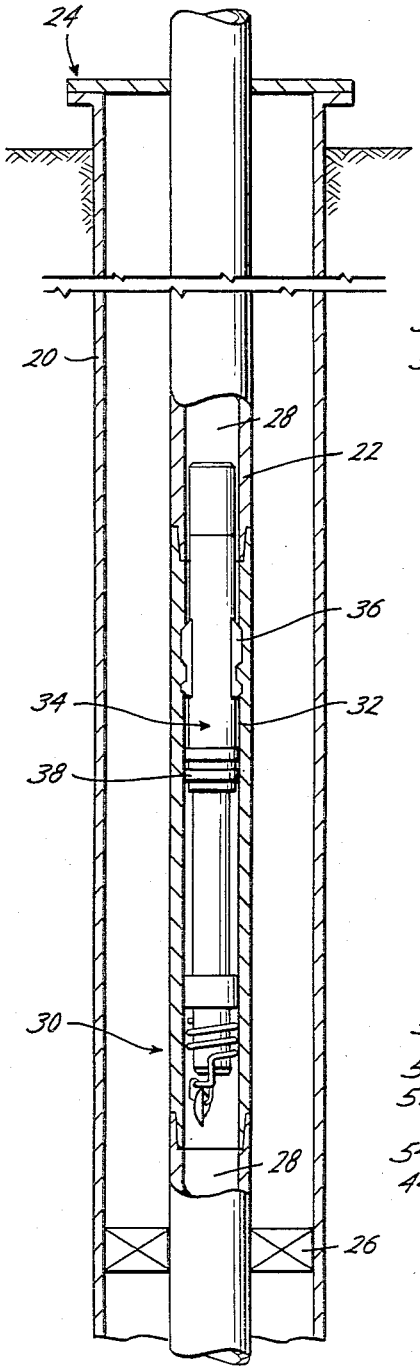
FIG. 1 is a schematic illustration of a well installation incorporating a pressure differential-type subsurface valve in accordance with this invention and having a flapper closure element.

A well may be equipped with a valve to control flow at a subsurface location in response to fluid and/or pressure conditions at the valve. A well installation incorporating such a valve is illustrated in FIG. 1.

The well is cased with the usual casing string 20. A production tubing string 22 extends through the casing string 20 between the producing formation (not shown) and the surface wellhead 24. Packer means 26 seals between the tubing string 22 and the casing string 20 to confine subsurface flow from the producing formation to the bore 28 through the tubing string 22. Subsurface valve 30 is positioned in the tubing string 22 and controls subsurface flow through the bore 28.

Subsurface valve 30 is landed, locked and sealed in a landing nipple 32. Landing nipple 32 forms a portion of the tubing string 22. A lock mandrel 34 is attached to the subsurface valve 30 and carries locking key means 36 and packing means 38.

In accordance with this invention, the subsurface valve 30 includes a flapper closure element. The pivotal mounting for the flapper closure element is flexible and is not rigid. Having a flexible pivotal mounting for the flapper closure element minimizes the likelihood that the pivotal mounting will take a plastic set or break. Additionally, such a flexible mounting permits a floating action between the flapper closure element and the valve seat. The floating action assures that the flapper valve member assumes a proper seating position and sealingly engages the valve seat.

Figure 2:
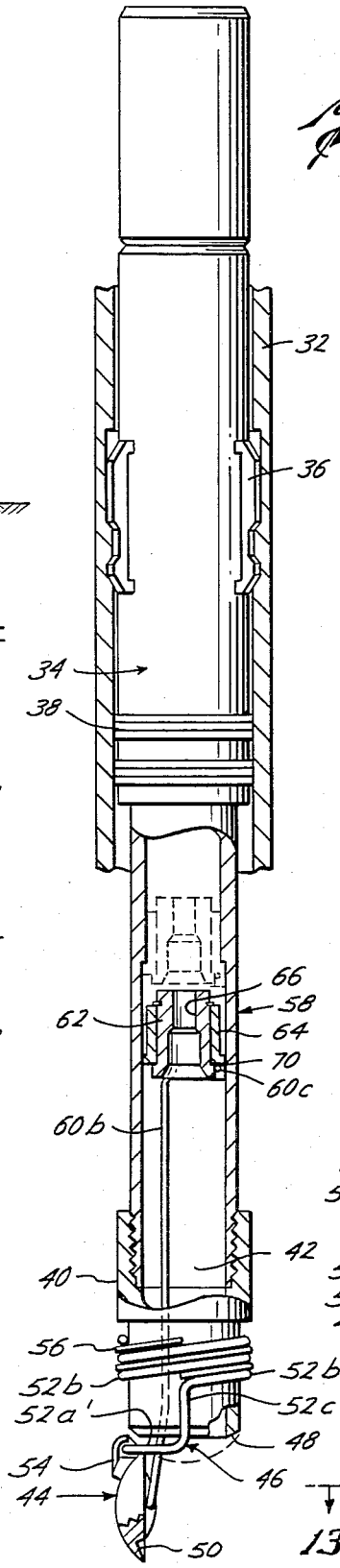
FIG. 2 is a view, partly in section and partly in elevation, of a first form of a valve useable in the well installation of FIG. 1.
Figure 3:
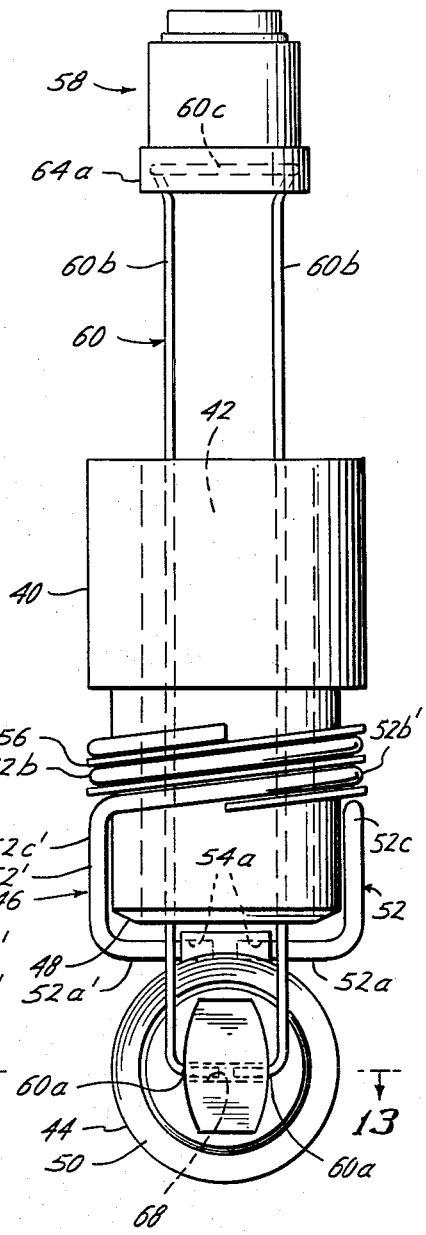
FIG. 3 is an elevational view of the valve of FIG. 2.

The details of a first form of a subsurface valve having a flapper closure element and structured in accordance with this invention are illustrated in FIGS. 2 and 3. The illustrated valve 30 is a normally opened, pressure-differential operated tubing safety valve.

As illustrated in FIG. 2, the subsurface valve 30 may be secured to a lock mandrel 34. The lock mandrel 34 may be a Type-X lock mandrel offered by Otis Engineering Corporation and illustrated on page 3958 of the "COMPOSITE CATALOG OF OILFIELD EQUIPMENT AND SERVICES", 1974–75 edition. If desired, a Type-X equalizing valve, as illustrated on page 3964 of the "COMPOSITE CATALOG OF OILFIELD EQUIPMENT AND SERVICES", 1974–75 edition may be positioned between the lock mandrel 34 and the subsurface valve 30.

The subsurface valve 30 includes body means 40 for defining a subsurface flow path 42. Flapper closure means 44 controls flow through the subsurface flow path 42. The flapper closure means 44 is mounted for pivotal movement on pivotal mounting means 46. Additionally, the valve 30 includes means for moving the flapper valve member means 44 between pivoted open and on-seat positions in response to flow and/or pressure conditions at the valve 30.

When the lock mandrel 34 is landed, locked and sealed in the landing nipple 32, subsurface flow through the tubing string bore 28 is confined to the flow path 42 extending longitudinally through body means 40. Seat means 48 is carried by body means 40 and surrounds the flow path 42.

Flapper closure means 44 is pivotally mounted for movement between a first, on-seat position and closing the flow path 42 (indicated in dotted form in FIG. 2) and a second position pivoted substantially out of and opening the flow path 42 (indicated in full line form in FIG. 2 and in FIG. 3). Flapper closure means 44 includes a seating surface 50 which sealingly engages seat means 48 when flapper closure means 44 is in its first on-seat position. When flapper closure means 44 is pivoted to its second position, it lies in a plane substantially at a right angle with respect to the plane of seat means 48.

Pivotal mounting means 46 pivotally supports flapper closure means 44. The pivotal mounting means 46 is inherently flexible and elastic. It flexes elastically when forces are exerted upon the flapper closure means 44. Because of this elastic flexture, the sometimes violent forces which are exerted upon flapper closure means 44 do not build up destructive stresses within pivotal mounting means 46. The geometry of pivotal mounting means 46 accommodates the flexture thereof while maintaining the desired valving cooperation between flapper closure means 44 and seat means 48. The pivotal mounting means 46 is formed from two hinge clips 52 and 52'. The hinge clips 52 and 52' mirror each other. In other words, one 52 may be considered a right-hand hinge clip while the other 52' may be considered a left-hand hinge clip. The details of only one will be described with the understanding that the other is similar.

An axis about which the flapper closure means 44 is pivoted is provided by the laterally extending hinge means portion 52*a* of the hinge clip 52. Each hinge clip is supported by body means 40. A helical portion 52*b* of the hinge clip 52 extends around and grips body means 40. Between the helical portion 52*b* and the hinge means portion 52*a*, extends a dog leg section. A portion 52*c* of the dog leg section extends longitudinally and substantially parallel to the longitudinal center line through body means 40. Another portion 52*a* of the dog leg section extends laterally and substantially parallel to the plane of seat means 48. Flapper closure means 44 includes offset hinge means 54 having pivot holes 54*a* therein. The ends of the hinge means portions 52*a* and 52*a'* of the hinge clips 52 and 52' are received within the pivot holes. Body means 40 includes, on its outer surface, helical retaining means 56. The helical portions 52*b* and 52*b'* of the hinge clips 52 and 52', respectively, are retained against axial movement with respect to body means 40 by their engagement with helical retaining means 56.

Flapper closure means 44 is moved between its on-seat position and pivoted full open position in response to flow and/or pressure conditions at the subsurface valve 30. The means for moving flapper closure means 44 includes actuator means 58 and means 60 for coupling the flapper closure means 44 to actuator means 58.

Actuator means 58 is axially movable with respect to body means 40. It moves axially in response to fluid flow conditions through the flow path 42. The illustrated actuator means 58 comprises floating flow restriction means 58. Flow restriction means 58 includes what is commonly known as a bean 62 and a bean holder 64. The bean 62 includes sized restricted flow means 66 extending longitudinally therethrough. The bean holder 64 includes an outer surface 64*a* which is sized to be closely adjacent to the wall defining the flow path 42. Therefore, fluid flow through the flow path 42 is essentially confined to the restricted flow means 66 of the bean 62. Upward fluid flow through the restricted flow means 66 creates a pressure differential across actuator means 58. The pressure differential tends to move actuator means 58 upwardly. The size of the restricted flow means 66 may be varied as desired. For a given fluid flow rate, the smaller the size of the restricted flow means 66 the greater the pressure differential across actuator means 58. As the valve 30 will be designed to close for a given flow rate, the size of the restricted flow means 66 is selected so that at the given flow rate, a pressure differential sufficient to move actuator means 58 is created by fluids flowing through the restricted flow means 66.

An inherently flexible coupling means 60 operably connects actuator means 58 and flapper closure means 44. Additionally, coupling means 60 includes torsioned spring-like members 60*a* which bias flapper valve member means 44 towards its second position pivoted substantially out of the subsurface flow path 42. However, upon a sufficient upward rate of flow through the flow restriction means 66, actuator means 58 moves upwardly. The spring-like torsion members 60*a* of coupling means 60 are overpowered and coupling means 60 moves flapper closure means 44 from its second position towards its first, on-seat position.

The spring-like portion of coupling means 60 is formed from two inwardly projection torsion members 60*a*. The torsion members 60*a* are relaxed when flapper closure means 44 is in its second position. The torsion members 60*a* resiliently resist movement of flapper closure means 44 from its second position towards its first position. Preferably, the inherent resilient force applied by the torsion members 60*a* varies depending upon the position of flapper closure means 44. To prevent inadvertent movement of flapper closure means 44 from its second, pivoted open position toward its first, on-seat position, the force applied by the torsion members 60*a* increases rapidly during the initial movement of flapper closure means 44 from its second position towards its first position. To prevent a motor effect, the force applied by the torsion members 60*a* decreases once flapper closure means 44 moves approximately half way from its second position towards its first position. However, even when flapper closure means 44 is in its on-seat position, the torsion members 60*a* still exert a force tending to move flapper closure means 44 to its second, full open position.

Figure 13:
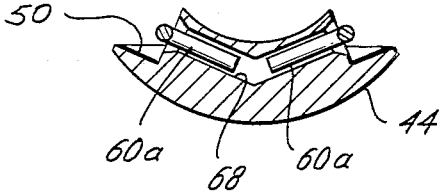
FIG. 13 is a cross-sectional view taken along line 13—13 of FIG. 3.

Flapper closure means 44 includes dog-legged lateral bore means 68 (see FIG. 13), the axis of which is off-set from the axis of pivot holes 54*a*. The inwardly projecting ends of the torsion members 60*a* are misaligned so that they may be received in dog-legged lateral bore means 68 (see FIG. 13). The torsion members 60*a* resiliently twist and bend during movement of flapper closure means 44.

Elongate members 60*a* of coupling means 60 extend between flapper closure means 44 and actuator means 58. A loop portion 60*c* is formed at one end of the elongate members 60*b* to join coupling means 60 to actuator means 58. The loop portion 60*c* may be confined within a recess 70 between the bean 62 and the bean holder 64. The torsion members 60*a* are formed at the other end of the couplings elongate members 60*b* and join the actuator means 58 and flapper closure means 44.

In operation, the subsurface valve 30 controls fluid flow through the tubing string bore 28 in response to pressure and/or flow conditions at the valve 30.

To position the valve 30 in the tubing string 22, the valve 30 is attached to a lock mandrel 34. The valve 30 and lock mandrel 34 assembly is run through the tubing string 22. Upon reaching the landing nipple 32, the locking key means 36 lock the assembly in the tubing string 22. Packing means 38 seals off the tubing string bore 28. Thereafter, fluid flow is confined. Fluid passage is limited to the flow path 42 extending longitudinally through valve body means 40.

The subsurface valve 30 is opened by equalizing pressures on opposite sides (above and below) of the flapper closure means 44. If an equalizing valve is positioned between the lock mandrel 34 and the subsurface valve 30, it is opened to equalize these pressures. In the absence of an equalizing valve, the pressures may be equalized by pumping fluid down the tubing string bore 28 above the subsurface valve 30. When the fluid pressures on opposite sides of flapper closure means 44 are substantially equalized, the torsion members 60*a* of coupling means 60 spring flapper closure means 44 to its second, pivoted full open position.

Fluid flow through the tubing string bore 28 is thereafter controlled by the valve 30. Fluid flow is confined to the flow path 42 through valve body means 40. Substantially all of the fluids flow through flow restriction means 66 of actuator means 58. Upward fluid flow therethrough creates a pressure differential across actuator means 58. That pressure differential tends to move actuator means 58 upwardly with respect to body means 40. The tendency of the upwardly acting force to move actuator means 58 is resisted by the torsion spring force applied to flapper closure means 44 by the torsion members 60*a*. As the flow rate increases, the upwardly acting pressure force increases. However, initially, the resistive torsion force also increases. When the flow rate is great enough, the upwardly acting pressure force becomes greater than the torsion spring force. Actuator means 58 is moved axially upwardly with respect to body means 40. Coupling means 60 moves axially with actuator means 58 and causes flapper closure means 44 to pivot towards its on-seat position. During the initial pivotal movement of flapper closure means 44, the torsion members 60*a* continue to increase their applied resistive force. If, however, the flow rate increases at a substantially constant rate, the pressure differential force effective upon actuator means 58 will become greater than the springlike resistive force applied to flapper closure means 44. Actuator means 58 will continue to move upwardly. Coupling means 60 continues to cause flapper closure means 44 to pivot towards its on-seat position. Flapper closure means 44 pivots and enters the fluid flow stream. With flapper closure means 44 in the fluid flow stream, the flow rate of fluids flowing through the restricted flow means 66 is reduced. Therefore, the pressure differential across actuator means 58 is reduced. However, at approximately the same time, the resistive force applied by torsion members 60*a* to flapper closure means 44 is reduced. Additionally, fluids impinging upon flapper closure means 44 urge flapper closure means 44 towards its on-seat position. The combined forces result in flapper closure means 44 being swiftly moved to a seating engagement with seat means 48 without a motor effect.

The movement of flapper closure means 44 does not impose destructive stresses upon flexible pivotal mounting means 46. Stresses which are imposed upon pivotal mounting means 46 result in elastic flexture thereof. When the stresses are relieved, pivotal mounting means 46 returns to its original configuration. There is sufficient elastic flexibility in pivotal mounting means 46 so that when flapper closure means 44 assumes its on-seat position, it can float concentrically with respect to body means 40. The floating action enables a sealing engagement between seating surface 50 of flapper closure means 44 and seat means 48. With a positive seating action attained between these two elements, fluid flow through the flow path 42 is prevented.

Once flapper closure means 44 has been pivoted to its on-seat position, fluids from the producing formation will be confined. That confinement will create a high pressure region below the valve 30. Most likely, a relatively low hydrostatic fluid pressure will be present in the tubing string bore 28 above the valve 30. A pressure differential will exist across flapper closure means 44. The resultant force of that pressure differential will maintain flapper closure means 44 in its on-seat position. The torsioned members 60*a* of coupling means 60 will resiliently urge flapper closure means 44 towards its second position pivoted away from seat means 48. However, as long as the force of the pressure differential is greater than the resilient urging force of the torsion members 60*a*, flapper closure means 44 will remain on-seat.

When the pressures of fluids on opposite sides of flapper closure means 44 are substantially equalized, torsion members 60*a* will pivot flapper closure means 44 towards its second position. Flapper closure means 44 will be pivoted towards its second position about the hinge means portion 52*a* of pivotal mounting means 46. When flapper closure means 44 becomes disposed substantially at right angles to the plane of seat means 48, the torsion members 60*a* are relaxed. Flapper closure means 44 is in its second position and is substantially out of the flow stream of fluids flowing through the flow path 42.

The valve 30 may therefore be repeatedly opened and closed in response to flow and pressure conditions.

Figure 4:
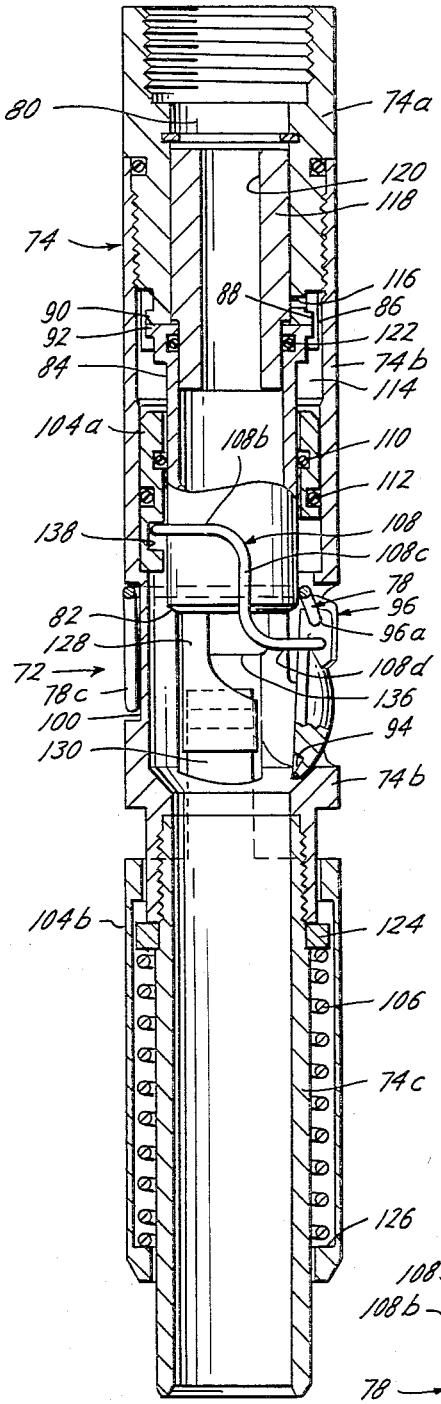
FIG. 4 is a view, partly in section and partly in elevation, of another form of a valve useable in the well installation of FIG. 1 with the flapper closure element in the pivoted open position.
Figure 5:
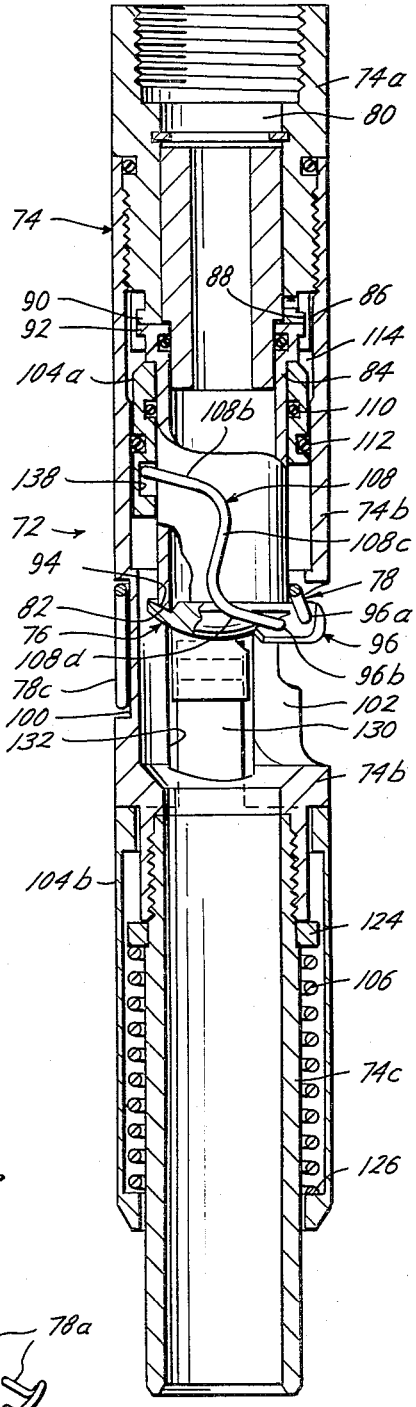
FIG. 5 is a view similar to FIG. 4 with the flapper closure element in the closed position.

FIGS. 4 through 10 illustrate another form of a subsurface valve constructed in accordance with this invention. The illustrated valve 72 is also responsive to flow and/or pressure conditions at the valve 72. In FIG. 4, the valve is illustrated opening the controlled subsurface flow path. In FIG. 5, the controlled subsurface flow path is closed.

This form of a subsurface safety valve 72 also includes body means 74, a flapper closure means 76 and an inherently and flexible and elastic pivotal mounting means 78 for the flapper closure means 76.

The subsurface valve 72 may be secured to a lock mandrel. The valve 72 and lock mandrel assembly may be landed, locked, and sealed in a landing nipple of a tubing string in a manner similar to the valve 30 previously described. If desired, an equalizing valve may be positioned in the assembly between the lock mandrel and the valve 72.

The illustrated subsurface safety valve 72 is a normally, opened velocity valve. It closes the controlled subsurface flow path when fluids flow therethrough at a predetermined, upward flow rate.

Valve body means 74 includes a longitudinally extending flow path 80. When the valve 72 is landed, locked and sealed in a landing nipple in a well tubing string, subsurface fluids must flow through the flow path 80. In addition to defining the flow path 80, body means 74 provides a stationary housing for relating other components of the valve 72. The illustrated body means 74 is comprised from interconnected tubular sections 74*a*, 74*b* and 74*c*.

Seat means 82 is carried by body means 74 and surrounds the flow path 80. Seat means 82 may be formed on seat member means 84. Seat member means 84 is in turn carried by body means 74. If desired, seat member means 84 may be formed integral with tubular body section 74*a*. Preferably, however, seat member means 84 is formed separately from body means 74 and is carried to float concentrically with respect to body means 74. The floating action assures positive seating of flapper closure means 76 on seat means 82 even though there may be minor eccentricities in any of body means 74, seat member means 84 and piston means 104*a*.

Retainer ring means 86 engages seat member means 84 and body means 74 so that seat member means 84 is carried by body means 74. Retainer ring means 86 permits seat member means 84 to float concentrically with respect to body means 74 and prevents seat member means 84 from moving axially with respect to body means 74. The illustrated retainer ring means comprises a split ring having an internal recess 88. The recess 88 receives a shoulder 90 of tubular body section 74*a* and a shoulder 92 of seat member means 84. The confinement of these shoulders 90 and 92 by retainer ring means 86 joins seat member means 84 to body means 74.

Flapper closure means 76 controls flow through the flow path 80. Flapper closure means 76 is movable between a first position opening the flow path and pivoted out of the flow path 80 (see FIG. 4) and a second, on-seat position closing the flow path 80 (see FIG. 5). When a flapper closure means 76 is in its first position, it lies in a place substantially at a right angle to the plane of seat means 82. Flapper closure means 76 includes a seating surface 94 for sealingly engaging seat means 82 when it is in its second, on-seat position.

Flapper closure means 76 also includes offset hinge means 96. Hinge means 96 has hinge holes 96*a* extending substantially parallel to the plane of seating surface 94. The hinge holes 96*a* receive the inwardly projecting hinge pin portion 78*a* of pivotal mounting means 78.

Figure 6:
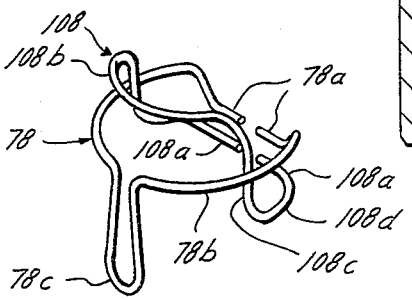
FIG. 6 is an elevational view showing the geometry of the pivotal mounting means and coupling means for the valve of FIGS. 4 and 5.
Figure 7:
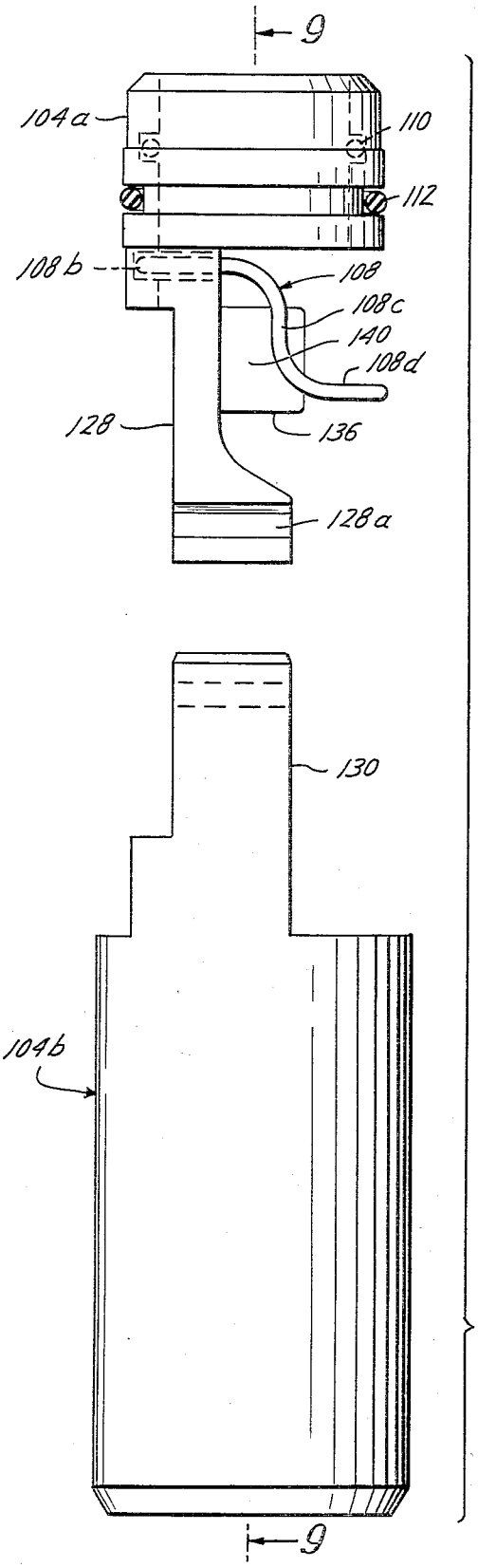
FIG. 7 is an exploded side elevational view of a portion of the actuator for the valve of FIGS. 4 and 5.
Figure 8:
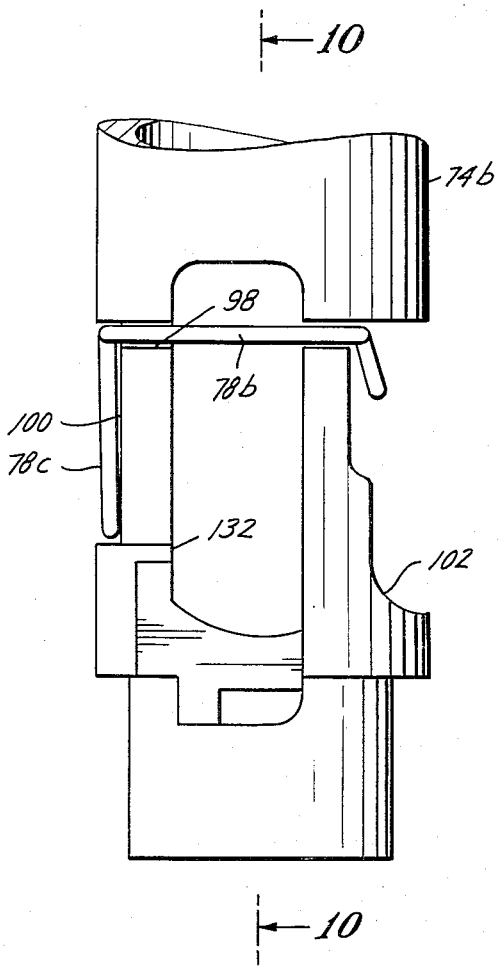
FIG. 8 is an elevational view of a portion of the housing for the valve of FIGS. 4 and 5.
Figure 10:
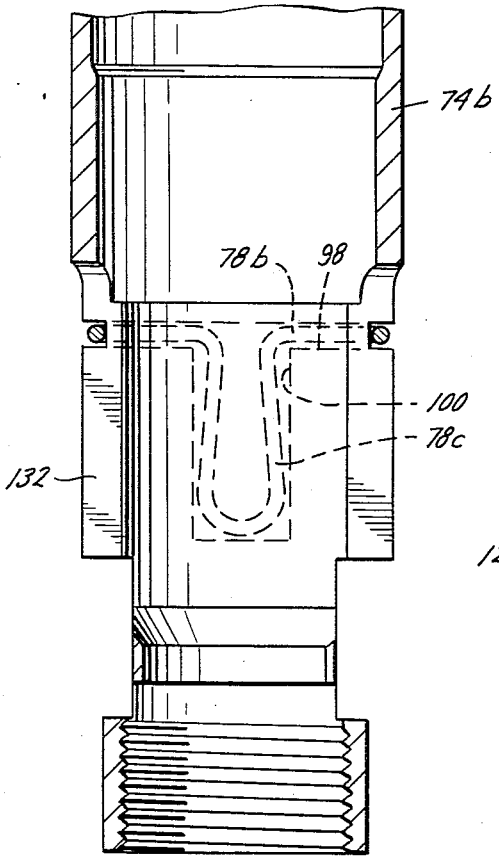
FIG. 10 is a cross-sectional view taken along line 10—10 of FIG. 8.
Figure 9:
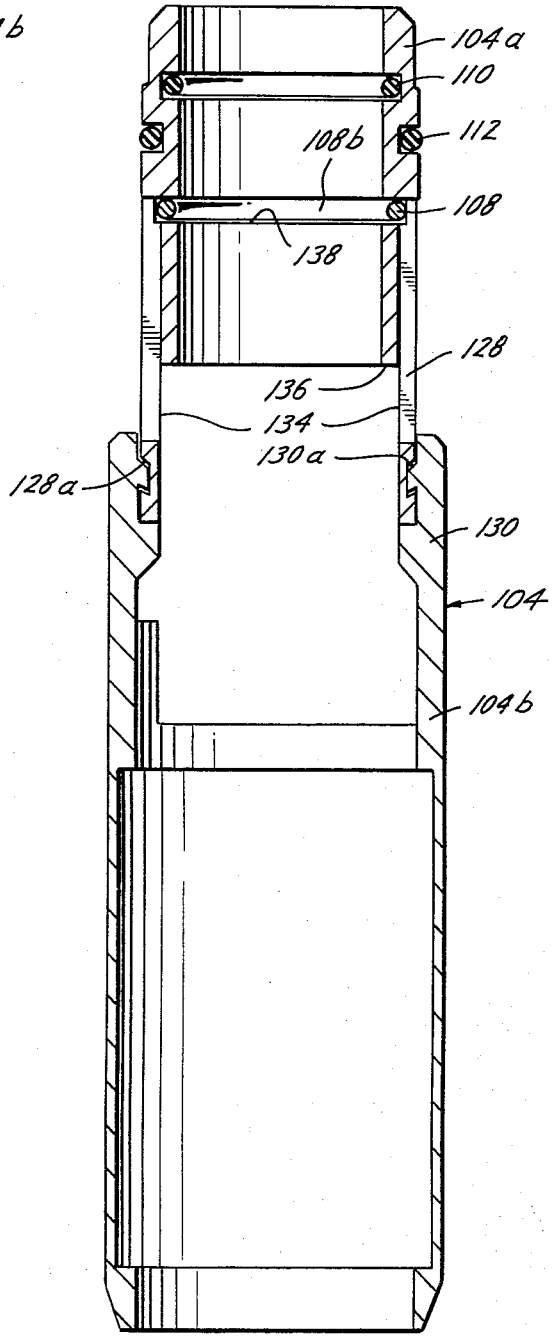
FIG. 9 is a cross-sectional view taken along line 9—9 of FIG. 7 with the parts joined together.

Pivotal mounting means 78 is carried by body means 74 and provides an axis about which flapper closure means 76 is pivoted. The pivot axis is offset laterally out of the flow stream of fluids flowing through the flow path 80. The pivotal mounting means 78 is inherently elastic and flexible. External stresses imposed upon pivotal mounting means 78 during operation of the valve 72 therefore result in elastic flexture of pivotal mounting means 78. Pivotal mounting means 78 is designed not to be stressed and strained beyond its elastic limit. When the external stresses are relieved, pivotal mounting means 78 returns to its original configuration. The geometry of pivotal mounting means 78 permits it to be carried by body means 74 and provide an off-set pivot axis for flapper closure means 76. The geometry of pivoting mounting means 78 is also designed so that the likelihood of pivotal mounting means 78 being twisted or otherwise distorted during movement of flapper closure means 76 is reduced. As best seen in FIG. 6, pivotal mounting means 78 includes aligned, projecting pivot pins 78*a*. The pivot pins 78*a* provide an off-set pivot axis for flapper closure means 76. Pivotal mounting means 78 also includes a circular portion 78*b* for engaging body means 74. The circular portion 78*b* is received within a recess 98 of tubular body section 74*b*. Opposite the projecting pivot pins 78*a*, flexible mounting means 78 forms a longitudinally extending loop portion 78*c*. The loop portion 78*c* is adapted to be received within a longitudinal eccentric turned portion 100 formed in the tubular body section 74*b*. Once pivotal mounting means 78 is positioned on body means 74, substantial movement of the pivot axis is prevented by the inherent strength of mounting means 78 and the engagement of the mounting means loop portion 78*c* with body means 74.

When flapper closure means 76 is pivoted about the pivot axis to its first, full open position, it is preferably out of stream of fluids flowing through the flow path 80. Tubular body section 74*b* includes a cut-out window 102 laterally opposite the eccentric turned portion 100. The window 102 provides a void in which flapper closure means 76 becomes disposed when in its first position.

Actuator means moves flapper closure means 76 between its full open position pivoted out of the fluid flow stream and its on-seat position. For the valve 72 illustrated, actuator means is yieldably urged to a first position. When in that first position, actuator means maintains flapper closure means 76 in its first position pivoted out of the flow path 80. A predetermined flow rate of fluids through the flow path 80 causes actuator means to move to a second position. Movement of actuator means to its second position pivots flapper closure means 76 to its second, on-seat position.

The actuator means comprises axially movable operator means 104, means 106 for yieldably urging operator means 104 towards its first position, and flexible coupling means 108 for coupling the pivotal movement of flapper closure means 76 to the axial movement of operator means 104.

The axially movable operator means 104 includes interconnected members 104*a* and 104*b*. One member 104*a*, comprises the piston body portion of pressure responsive means. The other member 104*b*, comprises a yoke body and is engaged by the yieldable urging means 106.

The pressure responsive means generates a force which is proportional to the flow rate of fluids flowing upwardly through the flow path 80. The force generated by the pressure responsive means tends to move operator means 104 towards its FIG. 5 position. An annular piston body portion 104*a* is disposed in the annulus between seat member means 84 and tubular body section 74*b*. Seal means 110 seals between the piston body 104*a* and valve seat member means 84; seal means 112 seals between piston body 104*a* and tubular body section 74*b*. Two pressure responsive areas are thus formed. Both areas are equal to the differential area between the seal means 110 and seal means 112. The one pressure responsive area is affected by fluids within a chamber 114. Chamber 114 is defined, in part, by body means 74 and valve seat member means 84. Port means 116 communicates between chamber means 114 and the flow path 80. The pressure of fluids flowing through the flow path 80 downstream from the flapper closure means 76 is therefore the pressure of fluid within chamber 114. That pressure affective across the one pressure responsive area creates a force which tends to move operator means 104 downwardly to its second (FIG. 4) position. The other area is subjected to the pressure of well fluids within the tubing bore upstream from the flapper closure means 76 (e.g. below the valve 72). Well pressure acting upon that other pressure responsive area tends to move operator means 104 upwardly towards its first (FIG. 5) position.

A differential between the pressure of fluids within chamber 114 and the pressure of well fluids below the valve 72 results in a net force being applied to the pressure responsive means. Certain flow conditions through the flow path 80 will create a pressure differential of a magnitude sufficient to move operator means 104 upwardly to its FIG. 5 position. For the illustrated valve 72, these flow conditions occur upon a predetermined upward flow rate of fluids through the flow path 80. The pressure differential, and the resultant differential pressure force, is porportional to the upward fluid flow rate. To create the differential in pressure between fluids within chamber 114 and fluids below the valve 72, fluid flow through the flow path 80 is restricted. The pressure of flowing fluids entering the restricted flow region will be greater than the pressure of flowing fluids leaving the restricted flow region. The pressure of fluid entering the restricted flow region will be the pressure of well fluids below the valve 72. The pressure of fluids leaving the restricted flow region will also be the pressure of fluids within chamber 114.

Fluid flow through the flow path 80 is restricted by bean means 118. Bean means 118 has a sized, flow restricting bore 120 extending longitudinally therethrough. The bean bore 120 is aligned with the flow path 80. The cross-sectional area of the bore 120 may be varied to change the magnitude of the pressure differential for a given flow rate.

Seal means 122 seals between bean means 118 and seat member means 84. The two pressure regions on opposite sides (above and below) bean means are thereby separated. Port means 116 open into the flow path 80 above seal means 122. The pressure of fluid within chamber 114 is therefore substantially equal to the pressure of fluids in the region above bean means 118.

The yoke member 104*b* of operator means 104 is engaged by the yieldable urging means 106. Yieldable urging means 106 yieldably urges this yoke member 104*b* downwardly. The operator means 104 is thereby yieldably urged to its first (FIG. 4) position. Yieldable urging means 106 may be the coil compression spring means 106 illustrated. Spring means 106 is disposed between a downwardly facing shoulder ring 124 associated with body means 74 and an upwardly facing shoulder 126 of operator member 104*b*.

The members 104*a* and 104*b* of operator means 104 are interconnected. The movement and position of operator means 104 is therefore dependent upon the greater of the resultant net pressure force applied to piston body member 104*a* and the yieldable urging force applied to yoke member 104*b*. The geometry of the interconnection between operator members 104*a* and 104*b* is complicated because the two members 104*a* and 104*b* extend away from each other to opposite sides (above and below) of flapper closure means 76. Furthermore, the piston body member 104*a* is disposed radially inwardly of a portion of body means 74 while the yoke member 104*b* is positioned radially exterially of body means 74. Regardless of these geometry complications, the operator members 104*a* and 104*b* are interconnected to move as a unit.

The piston body member 104*a* includes depending leg means 128. The yoke member 104*b* includes upstanding arm means 130. The outer profile 128*a* of leg means 128 and the inner profile 130*a* of arm means 130 interlock (see FIG. 9). The interlockage of leg means 128 and arm means 130 interconnects the two operator members 104*a* and 104*b*. Body section 74*b* has longitudinally extending slot means 132. The longitudinally extending opening through the wall of body means 74*b* provided by slot means 132 enables the interconnection between the two operator members 104*a* and 104*b*.

Leg means 128 do not interfere with movement of flapper closure means 76. The inwardly facing surfaces 134 of each leg means 128 are spaced. Flapper closure means 76 moves between the spaced surfaces 134.

A shock absorber effect dissipates energy and reduces internal stresses that would otherwise be applied to pivotal mounting means 78 during valve closure. Once flapper closure means 76 moves a portion of the way from its pivoted open (FIG. 4) position towards its on-seat (FIG. 5) position, flowing fluids impinge thereupon. The impinging fluids cause flapper closure means 76 to move swiftly towards its on-seat position. Without a shock absorber, flapper closure means will strike the longitudinally stationary seat means 82 with full force. Such an engagement would impart unacceptable stresses to flexible mounting means 78. Instead, prior to engaging seat means 82, flapper closure means 76 hits downwardly facing shoulder means 136 formed on operaor means 104. Flapper closure means 76 thereafter urges operator means 104 upwardly. However, a fluid within chamber 114 resists that upward movement. Fluid is forced out of the chamber 114 through port means 116. The outward flow of fluid is restricted due to the minimal clearance between bean means 118 and tubular body section 74*a*. To move operaor means 104 upwardly and force fluid out of chamber 114 therefore dissipates energy. The energy of the swiftly moving flapper closure means 76 is absorbed. When flapper closure means 76 engages the longitudinally stationary seat means 82, its energy is substantially dissipated. The stresses imparted to flexible pivotal mounting means 78 are thereby reduced to an acceptable level.

Flexible coupling means 108 moves with operator means 104 and pivots flapper closure means 76. Coupling means 108 flexes elastically and provides an elastic interconnection between operator means 104 and flapper closure means 76. The geometry of flexible coupling means 08 enables axial movement of operator means 104 to cause pivotal movement of flapper closure means 76. Additionally, the geometry enables coupling means 108 to be supported by operator means 104, to engage flapper closure means 76 and to be positioned out of the flow stream of fluids flowing through the flow path 80. Hinge means 96 of flapper closure means includes offset bore means 96*b*. Coupling means 108 includes laterally extending finger portions 108*a*. The finger portions 108*a* project towards each other and are received within the off-st bore means 96*b*. The piston body member 104*a* of operator means 104 includes an annular, inwardly facing recess means 138. Coupling means 108 includes an arced, semi-circular portion 108*b*. The semi-circular portion 108*b* rides within recess means 138. As seat member means 84 extends across the opening of recess means 138, the semi-circular portion 108*b* is confined in recess means 138. Because of that confinement, coupling means 108 moves axially substantially with operator means 104. Extending between the semi-circular portion 108*b* and each of the projecting finger portions 108*a* of coupling means are dog leg sections. The dog leg sections have substantially longitudinally portions 108*c* and substantially laterally extending portions 108*d*. The longitudinally extending portions 108*c* extend substantially parallel to the longitudinal axis through body means 74 and between the semi-circular portion and the plane of the projecting finger portions 108*a*. They are disposed exterior of the flap 140 of operator member 104*a* and are out of the flow stream of fluids flowing through the flow path 80. The laterally extending portions 108*d* extend laterally between the longitudinally extending portions 108*c* and the projecting finger portions 108*a*. It will be noted that the longitudinal width of recess means 138 is greater than the thickness of coupling means 108. Therefore, coupling means 108 may rock slightly during movement of operator means 104. The rockage of coupling means 108 and the inherent elastic flexibility of both coupling means 108 and pivotal mounting means 78 result in pivotal movement of flapper closure means 76 upon axial movement of operator means 104. During such movements, the stresses imposed upon pivotal mounting means 78 and coupling means 108 remain within the elastic limit of each. Because both can flex, neither is stressed plastically.

In operation, the subsurface valve 72 is utilized to control flow within a well. To position the valve 72 at a subsurface location within the well tubing string, valve body means section 74*a* is attached to a lock mandrel. Between valve body means 74 and the lock mandrel may be positioned an equalizing valve. The valve 72 and lock mandrel assembly is run through the bore of a well's tubing string. The lock mandrel lands and locks the assembly in a landing nipple. Packing seals the valve 72 in the bore of the tubing string. Thereafter, fluid flow through the tubing string bore is controlled by the subsurface valve 72.

To open the valve 72, fluid pressures above and below the valve 72 are substantially equalized. To equalize those fluid pressures, the equalizing valve may be opened. In the absence of an equalizing valve, fluids may be pumped down the bore of the tubing string and pressurized. When pressures on opposite sides of the subsurface valve 72 are substantially equalized, actuator means will move to its first position. Yieldable urging means 106 moves operator means 104 downwardly. Flexible coupling means 108 moves therewith due to the confinement of its loop portion 108*b* in recess 138. As it moves, flexible coupling means 108 pivots flapper closure means 76 about the projecting pivot pins 78*a* of pivotal mounting means 78. Flapper closure means 76 is pivoted until it lies in a plane which is substantially at a right angle to the plane of seat means 82. The valve 72 is now in the configuration illustrated in FIG. 4.

The subsurface valve 72 will remain opened until a predetermined flow rate occurs. Valve 72 is therefore normally opened. The flow rate at which the valve 72 will close can be varied, as desired, by altering the strength of yieldable urging means 106 and the cross-sectional area of flow of restriction bore means 120. For the illustrated valve 72, fluid flow in a first, upward direction through the flow path 80 will reduce the pressure of fluids within the chamber 114 to a pressure below that of flowing fluids below the valve 72. The pressure force which acts downwardly upon a pressure responsive means of operator means 104 will be reduced. Because of the pressure differential across the pressure responsive means, the resultant net pressure force urges operator means 104 upwardly. That net pressure force is resisted by the force of yieldable urging spring means 106. As the flow rate increases, the pressure differential increases. When the flow rate reaches the predetermined rate, the net pressure force exceeds the force of yieldable urging means 106. Upward movement of operator means 104 is initiated. Coupling means 108 moves therewith. Movement of coupling means 108 initiates pivotal movement of flapper closure means 76 towards its on-seat position.

After moving a portion of the way towards its on-seat position, flapper closure means 76 will enter the stream of upwardly flowing well fluids. The flowing well fluids will impinge upon flapper closure means 76 and urge it towards its on-seat position. The force of the impinging fluids moves flapper closure means 76 towards its on-seat position faster than coupling means 108 moves flapper closure means 76 towards that position. In fact, flapper closure means 76 moves so rapidly towards its onseat position, that it strikes the downwardly facing shoulder 136 of operator means 104 prior to movement of that shoulder 136 to a position longitudinally above seat means 82. Fluid within chamber 114 causes operator means to function as a shock absorber. Fluid is forced out of the chamber 114 through port means 116. That fluid movement is restricted due to the closely spaced relationship between bean means 118 and body means 74. Operator means 104 continues its upward movement towards its second (FIG. 5) position until flapper closure means 76 sealingly engages seat means 82. By that time, however, the affect the primary force affecting flapper closure means 76 changing from the force applied by coupling means 108 to the impinging pressure force of downhole well fluids is smoothed out. With the force conversion smoothed out, resonance is reduced and the forces imposed upon flexible coupling means 108 and pivotal mounting means 78 are reduced. Therefore, these elements are not stressed beyond their elastic limit. They do, however, flex elastically. That designed elastic flexture and the designed concentric floating of seat member means 84 within body means 74 permits flapper closure means 76 to become aligned with seat means 82 and sealingly engage therewith. Once flapper closure means 76 has been moved to its on-seat position and closes the flow pah 80, it will remain in that position until pressures are substantially equalized across the subsurface valve 72. Those pressures may be equalized in the manner aforedescribed.

Valve 72 as shown in FIG. 4 is particularly well suited to minimize any forces tending to cause flapper closure means 76 to motor. The relatively large sensing area formed by seals 110 and 112 permits a low differential pressure between chamber 114 and the bore of valve 72 to actuate flapper closure means 76. The engagement of flapper closure means 76 with shoulder 136 results in some throttling of the flow through valve 72 before flapper closure means 76 with shoulder 136 results in some throttling of the flow through valve 72 before flapper closure means 76 seals with seat means 82. Both of these features reduce the negative pressure spike which is present when conventional free swinging flappers go on seat. Flexible coupling means 108 and operator member 104*a* cooperate to throttle any reverse flow which might occur through valve 72 as the result of a negative pressure spike when flapper closure means 76 engages seat means 82.

In conventional direct controlled subsurface safety valves, sensing area is usually smaller than the valve seat. In valve 72 the sensing area formed by seals 110 and 112 is considerably longer than the valve seat. Also, as flapper closure means 76 throttles flow through valve 72, the sensing area is not effected. The sensing area of valve 72 remains exposed to full formation pressure at all times.

FIG. 11 illustrates a well installation incorporating another form of a subsurface valve structured in accordance with this invention. This form of a subsurface valve is a surface controlled subsurface tubing safety valve.

The well is cased with a casing string 160. A tubing string 162 extends through the casing string 160. Packer means 164 seals off the annulus 166 between the casing string 160 and the tubing string 162. Fluid flow from the producing formation (not shown) is thereby confined to the bore 168 of the tubing string 162. Valve 170 controls flow through the tubing string bore 168 at a subsurface location in the well. Landing nipple 172 forms a portion of the tubing string 162. The valve 170 is landed, locked and sealed in the landing nipple 172. Lock mandrel 174 is attached to the valve 170 and lands and locks the valve 170 in the landing nipple 172. Packing means 176 and 178 seal between the landing nipple 172 and one of the lock mandrel 174 and the valve 170, respectively. The subsurface valve 170 is controlled from the surface of the well installation. Control conduit means 180 extends between the landing nipple 172 and an operating manifold 182 located at the surface. Operating manifold 182 pressurizes or depressurizes control fluid and pumps it into control conduit means 180. Upon sufficient pressurization of control fluid, the valve 170 assumes an operative position permitting subsurface flow through the tubing string bore 168. When control fluid is depressurized below that sufficient amount, the subsurface valve 170 assumes an operative position preventing flow through the tubing string bore 168.

The detailed structure of the valve 170 is illustrated in FIG. 12. The valve 170 is illustrated in FIG. 12 closing the flow path through the bore 168 of the tubing string 162.

The valve 170 is normally closed. It is opened when control fluid is pressurized a sufficient amount. Certain components of the valve 170 may be the same as those utilized in the valve 72 previously described. Where possible, those components will be designated with numerals that correspond to their previous designation except for the addition of a prime. Those components of the valve 170 which are different from the components of the valve 72 previously described generally relate to rendering the valve 170 normally closed and controllable by pressurized control fluid.

The subsurface valve 170 includes body means 184 and a flapper closure means 76' pivotally mounted on flexible means 78'. Actuator means moves flapper closure means 76' between its on-seat position and pivoted full open position.

Body means 184 includes a longitudinally extending flow passage means 186 through which subsurface fluid flow is confined. Body means 184 additionally provides a stationary housing for the subsurface safety valve 170. Forming body means 184 are interconnected tubular sections **184*a*, 184*b*, 184*c* and 184*d*. Tubular section 184*c* may be the same as tubular body section 74*b* previously described. Thus the body section 184*c* includes an annular recess 98' in its outer surface for receiving the loop portion 78*b*' of the pivotal mounting means 78'. The body section 184*c* also includes an eccentric turned portion 100' for the loop portion 78*c*' of the pivotal mounting means 78' and a cut-out window 102' into which the flapper closure means 76'** is pivotable.

Seat means 188 is carried by body means 184 and is disposed around the subsurface flow passage means 186. Seat means 188 floats concentrically within the stationary tubular body sections **184*a*, 184*b* and 184*c*. It is formed on seat member means 190 associated with body means 184. Retainer ring means 192 engages tubular body section 184*a* and seat member means 190 to retain seat member means 190 in body means 184**.

Flapper closure means 76' controls flow through flow passage means 186. A seating surface 94' sealingly engages seat means 188 whenever flapper closure means 76' is pivoted to its on-seat position. Flapper closure means 76' is pivotable to a position spaced from seat means 188 and lying in a plane substantially at right angles to the plane of seat means 188.

Pivotal mounting means 78' is carried by body means 184, engage flapper closure means 76' and provide a pivot axis for the pivotal movement of the flapper closure means 76'.

Actuator means controls movement of flapper closure means 76' between its on-seat position and its pivoted full open position. Actuator means normally urges flapper closure means 76' to its on-seat position and is responsive to pressurized control fluid. Whenever control fluid is pressurized a sufficient amount, actuator means moves flapper closure means 76' to its pivoted full open position. Actuator means includes axially movable operator means 194 and flexible coupling means 108'. Axial movement of operator means 194 with respect to body means 184 moves coupling means 108'. Coupling means 108' in turn pivots flapper closure means 76'.

Operator means 194 is axially movable between a first position (see FIG. 12) and a second position (see FIG. 11). The first position of operator means 194 is the position to which it is normally urged. In that position of operator means 194, flapper closure means 76' is in its on-seat position. The second position of operator means 194 is the position to which it is moved whenever control fluid is pressurized a sufficient amount. In that second position of operator means 194, flapper closure means 76' is pivoted to its position away from seat means 188 and out of the flow passage means 186.

A portion of operator means 194 is affected by pressurized control fluid. An annular piston means section **194*a* of operator means 194 is disposed between tubular housing section 184*c* and valve seat member means 190. Control pressure chamber means 196 extends between control conduit means 180 and the piston means section 194*a*. Seal means 198 seals between tubular body section 184*a* and valve seat member means 190. Seal means 200 and 202 seal between piston means section 194*a* and one of tubular body section 184*c* and valve seat member means 190, respectively. Control fluid is confined by these seal means 198, 200 and 202 to control pressure chamber means 196. Control pressure chamber means 196 includes lateral port means 196*a* extending through tubular housing section 84*a*; the annular chamber 196*b* around seat member means 190 and extending longitudinally between lateral port means 196*a* and retainer ring means 192, port means 196*c* extending laterally through tubular body section 184*b*; and the annular chamber 196*d* between tubular body section 184*b* and valve seat member means 190**.

Operator means 194 also includes yoke means section **194*b*. The yoke means section 194*b* is interconnected with the piston means section 194*a* via interlocking leg and arm means 128' and 130'**, respectively, as previously described.

Yieldable urging means, such as the coil compression spring means 204 shown, engages the yoke means section **194*b* and yieldable urges operator means 194 towards its first position. The yieldable urging means 204 is disposed between an upwardly facing shoulder 206 associated with tubular body section 184*d* and the downwardly facing shoulder 208 associated with yoke means section 194*b***.

The piston means section **194*a* for this embodiment of a safety valve is structured the same as the piston means section 104*a* previously described. This piston means section 194*a*** thus includes a downwardly facing energy absorbing shoulder (not shown).

In operation, the subsurface safety valve 170 controls flow at a subsurface location in a well in response to surface controls.

The subsurface safety valve 170 is positioned at the desired subsurface location in the tubing string 172 by known techniques.

The safety valve 170 is normally closed. Yieldable uring means 204 exerts a force in a first, upward, direction on the yoke means section **194*b* of operator means 194. The force exerted by the yieldable urging means 204 is normally sufficient to maintain operator means 194 in its first position. Flapper closure means 76'** is in its on-seat position.

Hydraulic control fluid, the pressure of which is controlled from the surface, opens the subsurface safety valve 170. Operating manifold 182 pressurizes control fluid and pumps it into control conduit means 180. The pressure of hydraulic control fluid within control pressure chamber means 196 increases. That pressure exerts a force on the piston means section 194*a* of operator means in a second, downward, direction. However, the pressure of shut-in well fluids is simultaneously exerting a force on the piston means section 194*a* in a first, upward, direction. Movement of operator means 194 in a second, downward, direction towards its second position will not occur until the force applied upon the piston means section 194*a* by pressurized control fluid is greater than the sum of the force applied on the piston means section by the pressure of shut-in well fluids and the force of the yieldable urging means 204. When the pressure of control fluid within control pressure chamber means 196 is sufficient movement of operator means 194 is initiated. Initially, flapper closure means 76' is held in its on-seat position with shut-in well fluids exerting a pressure force thereacross. The downwardly facing shoulder associated with operator means 194 engages flapper closure means 76'. Upon continued downward movement of operator means 194, flapper closure means 76' is pushed to a position slightly spaced from seat means 188 by that downwardly facing shoulder. Once the seating surface 94' of flapper closure means 76' is spaced from seat means 188, well fluids flow upwardly past flapper closure means 76'. Fluid pressures are thereby equalized on opposite sides of flapper closure means 76'. This pressure equalization occurs prior to pivotal movement of flapper closure means 76'. Conventional surface controlled subsurface flapper type safety valves frequently require pressurizing the tubing string from the well surface to equalize pressure across the flapper element. The flexible nature of pivotal mounting means 78' and flexible coupling means 108' has permitted the slight longitudinal movement of flapper closure means 76' without pivotal movement thereof. The force which has moved flapper closure means 76' has been applied by a positive shoulder. The pivotal mounting means 78' and flexible coupling means 108' are not required to develop a force sufficient to move flapper closure means 76'. Therefore, the stresses imposed upon these components during this initial opening movement of flapper closure means 76' are relatively small. The stresses imposed will be below the yield stresses for each. Additionally, no violent impactive forces are imparted to either member.

After pressures have been equalized across flapper closure means 76, operator means 194 continues its downward movement towards its second position. Such movement of operator means 194 results in flexible coupling means 108' producing a moment arm which pivots flapper closure means 76'. Flapper closure means 76' is pivoted about flexible pivotal mounting means 78' until it attains its pivoted full open position lying in a plane substantially at right angles to the plane of seat means 188.

The flow passage means 186 is thereby fully opened. Subsurface flow of well fluids through the tubing string bore is permitted. Regardless of flow conditions through the subsurface safety valve 179, as long as the pressure of control fluid within control pressure chamber means 196 exceeds the pressure of fluids at the valve 170, flapper closure means 76' remain in its pivoted full open position.

If, for any reason, the pressure of control fluid within control pressure chamber means 196 falls below the pressure of fluids at the valve 170, closure of the valve 170 will be initiated. Well fluids at the valve 170 and the yieldable urging means 204 exert an upwardly acting force on operator means 194 which force tends to move operator means 194 towards its first position. Upward movement of operator means 194 moves flexible coupling means 108'. Flapper closure means 76' is pivoted by flexible coupling means 108' towards its on-seat position. During movement of flapper closure means 76' towards its on-seat position, flapper closure means 76' enters the stream of fluids flowing upwardly through flow passage means 186. The flowing fluids exert an impactive pressure force upon flapper closure means 76'. The impactive pressure force tends to rapidly move flapper closure means 76' towards its on-seat position. Thereafter, flapper valve member means 76' moves towards its on-seat position faster than operator means 194 moves to its first position. (The presence of control fluid within control pressure chamber means 96 and the hydrostatic head of control fluid in control conduit means 180 retards movement of operator means 194 towards its first position.) Because of the relative speed of movement of flapper closure means 76' and operator means 194, flapper closure means 76' will engage the downwardly facing shoulder of operator means 194 prior to engaging seat means 188. The engagement of flapper valve member means 76' with shoulder will urge operator means 194 upwardly. The fluid retarding upward movement of operator means 194 will absorb the shock which occurs when flapper closure means 76' strikes shoulder. The energy of the swiftly moving flapper closure means 76' will be dissipated and the affect of the primary force affecting flapper closure means 76' changing from the force applied by coupling means 108 to the impinging pressure force of downhole well fluids is smoothed out. The smoothing out of the force conversion reduces the likelihood of resonance and reduces the forces imposed upon flexible coupling means 108' and flexible pivotal mounting means 78'. These elements may therefore flex elastically within their elastic limit. The seating surface 94' of flapper closure means 76' sealingly engages seat means 188. Fluid flow through the subsurface valve 170 is prevented.

Once flapper closure means 76' has been moved to its on-seat position, upward fluid flow through the subsurface safety valve 170 will be prevented until affirmative action is taken to pressurize control fluid. That affirmative action will open the subsurface valve 170 as previously described.

From the foregoing, it can be seen that the objects of this invention have been obtained. An improved subsurface valve having a flapper closure element has been provided. For each form of the subsurface valve, the flapper closure element is mounted on a flexible pivotal mounting. The flapper closure element therefore pivots about a slightly movable pivot point. The pivotal mounting is designed to be flexible and to flex within its elastic limit during pivotal movement of the flapper closure element. All forms of the subsurface valve include an actuator which controls movement of the flapper closure element. The flapper closure element may be normally urged by the actuator to either an on-seat position or to a pivoted full open position. Regardless of the position towards which the actuator means urges the flapper closure element, the flapper closure element is moved to its other position by the actuator under appropriate conditions. In two forms of the subsurface valve, the flapper closure element is moved in response to fluid flow and pressure conditions at the valve. In a third form of the subsurface valve, the flapper closure element is movable in response to surface controls. All forms of the subsurface valve include a flexible coupling which provides the moment arm for pivoting the flapper closure element around the movable pivot point. In one form of the subsurface valve, the coupling itself provides the resilient urging force which tends to move the flapper valve member. In other forms of the valve, an additional yieldable urging means urges the flapper closure element to its normal position. For the form of the subsurface valve wherein the flexible coupling provides the resilient urging force, the force tending to move the flapper closure element does not vary linearally. For that form of a safety valve, the flexible coupling means urges the flapper closure element towards its fully open position. During valve closure, the coupling resists the closing pivotal movement of the flapper closure element. The resistive force initially increases, but, after slight movement of the flapper closure element decreases. The initial force increase applied by the coupling assures that only a designed flow rate will result in valve closure. The force decrease after that initial force increase prevents a motor affect and assures that closure is not inhibited. For the second and third forms of the subsurface valve, the actuator includes a force dissipator. The energy of the swiftly moving flapper valve member is dissipated prior to the flapper closure element's engagement with its seat. The energy dissipator does not have to be moved a long distance to enable the flapper closure element to engage its seat. Therefore, closure is swifter than previous subsurface flapper valves which have incorporated a long flow tube. The swift closure results in more responsive control of fluid flow conditions than has heretofore been possible. Additionally, the force dissipator permits the surface controlled form of the subsurface valve to be moved to its full open position without the required opening of a separate equalizing flow passage and without imparting excessive strains and stresses on the pivot mounting. Presently, either a separate equalizing passage is required for the valve or otherwise excessive opening forces would be imposed on the flapper pivot. Thus, regardless of the specific form, the improved subsurface valve of this invention provides definite advantages over prior art subsurface valves having flapper closure elements.

The foregoing disclosure and description of the invention are illustrative and explantory. Various changes may be made in the size, shape, and materials, as well as in the details of the illustrated construction, within the scope of the appended claims and without departing from the spirit of the invention.

What is claimed is:

1. A subsurface valve comprising:
- body means including flow passage means extending therethrough;
- seat means carried by said body means and disposed around said flow passage means;
- flapper closure means;
- flexible hinge means for pivotally supporting said flapper closure means so that said flapper closure means is movable between an on-seat position engaging said seat means and a full open position pivoted away from said seat means;
- actuator means axially movable with respect to said body means; and
- elastic coupling means for operably connecting said actuator means and said flapper closure means.

2. The flapper valve of claim 1 wherein said flexible hinge means includes:
- a first portion extending around and supported by said body means;
- hinge pin means about which said flapper closure means is pivoted; and
- a leg portion extending between said first portion and said hinge pin means.

3. The subsurface valve of claim 1 wherein said elastic coupling means includes:
- a loop portion engaging said actuator means;
- arm means engaging said flapper closure means;
- an elongate portion extending between said loop portion and said arm means.

4. The subsurface valve of claim 1 wherein said actuator means includes:
- floating flow restriction means adapted to be disposed in said flow passage means, said floating flow restriction means moving in a first direction upon fluid movement in that same first direction to cause said flapper closure means to move towards its on-seat position.

5. The subsurface valve of claim 1 wherein:
- said actuator means comprises operator means axially movable with respect to said body means;
- yieldable urging means for urging said operator means to a first position wherein said flapper closure means is in one of said on-seat position and said position pivoted away from said seat means; and
- pressure responsive means for moving said operator means to a second position wherein said flapper closure means is in the other of said on-seat position and said position pivoted away from said seat means.

6. The subsurface valve of claim 5 wherein said pressure responsive means is subjected to the pressure of fluids flowing through said flow passage means.

7. The subsurface valve of claim 5 wherein said pressure responsive means is affected by the pressure of control fluid conducted to said subsurface valve.

8. A subsurface valve comprising:
- body means including flow passage means extending therethrough;
- seat means carried by said body means and extending around said flow passage means;
- flapper closure means;
- flexible hinge means for pivotally supporting said flapper closure means and including:
  - a first portion engaging and supported by said body means,
  - hinge pin means upon which said flapper closure means is pivoted, and
  - a leg portion extending between said first portion and said hinge pin means;
- actuator means axially movable with respect to said body means and including floating flow restriction means disposed in said flow passage means; and
- elastic coupling means for operably connecting said actuator means and said flapper closure means and including:
  - a loop portion engageable with and movable by said actuator means,
  - torsion arm means engaging said flapper closure means and yieldably urging said flapper closure means to a position pivoted off of said seat means and substantially at right angles to the plane of said seat means, and
  - an elongate portion interconnecting said loop portion and said torsion arm means.

9. A subsurface valve comprising:

body means including flow passage means extending therethrough; and seat means carried by said body means and extending around said flow passage means;

flapper closure means;

flexible hinge means for pivotally supporting said flapper closure means so that said flapper closure means is movable between an on-seat position and a position pivoted away from said seat means and lying in a plane substantially at right angles to the plane of said seat means, said flexible hinge means including:

a first portion engaging and supported by said body means, hinge pin means upon which said flapper closure means is pivoted, and a leg portion extending between said first portion and sad hinge pin means;

actuator means axially movable with respect to said body means; and elastic coupling means for operably connecting said actuator means and said flapper closure means and including:

a loop portion engageable by and movable with said actuator means, and torsioned arm means engaging said flapper closure means and yieldably urging said flapper closure means to its position pivoted away from said seat means, and an elongate portion interconnecting said loop portion and said torsion arm means.

10. A subsurface valve comprising:

body means including flow passage means extending therethrough;

seat means carried by said body means and extending around said flow passage means;

flapper closure means;

flexible hinge means for pivotally supporting said flapper closure means so that said flapper closure means is movable between an on-seat position and a position pivoted away from said seat means and lying substantially at right angles to the plane of said seat means;

actuator means for controlling movement of said flapper closure means and axially movable with respect to said body means and including floating flow restriction means disposed in said flow passage means;

elastic coupling means for operably connecting said actuating means and said flapper closure means and including:

a loop portion associated with and movable by said actuator means, and torsion arm means engaging said flapper closure means and yieldably urging said flapper closure means to its position pivoted away from said seat means, and an elongate portion interconnecting said loop portion and said torsion arm means.

11. A subsurface valve comprising:

body means including flow passage means extending therethrough;

seat means carried by said body means and extending around said flow passage means;

flapper closure means;

flexible hinge means for pivotally supporting said flapper closure means so that said flapper closure means is movable between an on-seat position and a position pivoted away from said seat means and lying in a plane substantially at right angles to the plane of said seat means;

actuator means for controlling movement of said flapper closure means and including:

operator means axially movable with respect to said body means between a first position and a second position, yieldable means for resiliently urging said operator means towards one of said first position and said second position, pressure responsive means for urging said operator means towards the other of said first position and said second position, and flexible coupling means movable by said operator means for pivoting said flapper closure means about said flexible hinge means upon axial movement of said operator means.

12. The subsurface valve of claim 11 additionally including:

seat member means disposed within said body means and having said seat means formed thereon;

retainer ring means for retaining said seat member means in said body means and preventing relative longitudinal movement of said seat member means with respect to said body means while permitting relative concentric movement of said seat member means with respect to said body means.

13. The subsurface valve of claim 11 additionally including:

flow restriction means disposed in said flow passage means;

means for communicating the pressure of fluids on the downstream side of said flow restriction means to one side of said pressure responsive means;

means for communicating fluid from the upstream side of said subsurface valve to the other side of said pressure responsive means;

wherein said yieldable urging means urges said flapper closure means to its position pivoted away from said valve seat means.

14. The flapper valve of claim 11 additionally including:

means for subjecting one side of said pressure responsive means to the pressure of fluid conducted to said subsurface valve from the surface;

means for subjecting the other side of said pressure responsive means to the pressure of fluids upstream from said subsurface valve;

wherein said yieldable urging means urges said operator means towards a position wherein said flapper closure means is in said on-seat position.

15. The subsurface valve of claim 11 wherein said operator means includes:

piston means section on one side, longitudinally, of said flapper closure means; and yoke means section on the other side, longitudinally, of said closure member means and engageable by said yieldable urging means; and means for interconnecting said piston means section and said yoke means section.

16. The subsurface valve of claim 11 additionally including:

shoulder means formed on said operator means for engaging and pushing said flapper closure means away from its on-seat position during axial movement of said operator means in a first direction and for being engaged by and dissipating the energy of said flapper closure means prior to said flapper closure means engaging said seat means during movement of said flapper closure means towards its on-seat position.

* * * * *

UNITED STATES PATENT AND TRADEMARK OFFICE

CERTIFICATE OF CORRECTION

PATENT NO. : 4,216,830

DATED : August 12, 1980

INVENTOR(S) : John V. Fredd

It is certified that error appears in the above—identified patent and that said Letters Patent is hereby corrected as shown below:

Column 10, line 55, "fluid" should read "fluids".
Column 11, line 2, "open" should read "opens".
Column 11, line 62, operaor should read "operator".
Column 11, line 63, delete "a";
Column 11, line 68, "operaor" should read "operator".
Column 12, line 13, "08" should read "108";
Column 12, line 23, "st" should read "set";
Column 14, line 10, "pah" should read "path";
Column 14, line 35, "longer" should read "larger";
Column 16, line 40, "yieldable" should read "yieldably";
Column 19, line 12, delete "rally" and insert "ally";
Column 19, line 46, delete "explantory" insert"explanatory";
Column 21, line 18, delete "sad" insert "said";

Signed and Sealed this

*Tenth* Day of *February 1981*

[SEAL]

*Attest:*

RENE D. TEGTMEYER

*Attesting Officer*

*Acting Commissioner of Patents and Trademarks*